United States Patent [19]

Chrisp

[11] Patent Number: 4,503,302

[45] Date of Patent: Mar. 5, 1985

[54] ARC INTERRUPTER

[75] Inventor: George F. Chrisp, Newcastle upon Tyne, England

[73] Assignee: Northern Engineering Industries PLC, NewCastle upon Tyne, England

[21] Appl. No.: 481,457

[22] Filed: Apr. 1, 1983

[30] Foreign Application Priority Data

Apr. 17, 1982 [GB] United Kingdom ..... 8211203

[51] Int. Cl.[3] ..... H01H 33/18

[52] U.S. Cl. ..... 200/147 R

[58] Field of Search ..... 200/147 R

[56] References Cited

U.S. PATENT DOCUMENTS 3,471,666 10/1969 Barkan ..... 200/147 R 4,355,219 10/1982 Parry ..... 200/147 R

OTHER PUBLICATIONS

"About the $SF_6$ Gas Circuit Breaker of Rated 3.6/7.2 KV," Japan Electric Commity, Published 1970, Ono Shunichiro, Fujiwara Kazushi et al., (Yasukawa Electric Works).

"Arc Behavior & Breaking Characteristic of $SF_6$ Gas Circuit Breaker of Rotary Arc Extinguishing System," Japan Electric Commity, Published 1981, Fujiwara Kazushi et al., (Yasukawa Electric Works).

*Primary Examiner*—Robert S. Macon

[57] ABSTRACT

An electric switch has an arc interrupter mounted in a housing between two main conductors. The interrupter comprises a fixed contact having a first arcing surface, a fixed electrode having a second arcing surface, an arc-driving coil and a movable contact, the surfaces and the coil being coaxial with one another and the contact being mounted for angular movement about a pivot axis between a make position and a break position. During opening of the interrupter, an arc is initially struck between the contacts after which it is transferred from the contact to the electrode. The coil, now being part of the arc current path, produces a magnetic flux which interacts with the arc so that it is driven around the axis between the surfaces. That movement of the arc assists in extinguishing the arc at an appropriate current zero. Ferromagnetic material forms part of the magnetic circuit of the coil. Two interrupters can be arranged in series between the main conductors. Alternatively, the interrupter can have two fixed contacts, two movable contacts and two coils.

14 Claims, 5 Drawing Figures

10
12
14
16
18
20
22
24
26
28
30
32
34
36
38
40
42
44
46
48
50
52
54
56
58
60
62
64
66
68
70
72
74
76
78
80
82
84
86
90
92
94
96
98
100
102
104
106
II
II

ARC INTERRUPTER

BACKGROUND TO THE INVENTION

The invention relates to arc interrupters.

An electric switch has been proposed, for example in United Kingdom patent application No. 79 39949 (Publication No. 2044538 A), in which in an arc interrupter used therein an arc drawn between separating contacts is transferred from a fixed contact to an annular arcing electrode which is coaxial with an arc-driving coil through which the arc current flows. The resulting magnetic field drives the arc around the electrode and ultimately the arc is extinguished.

The arc roots on the movable contact which, in its fully open break position, should ideally be exactly centrally positioned with respect to the electrode. However, the behaviour of the arc after it has been transferred is very sensitive to the relative positioning of the contact and the electrode. Any eccentricity in the positioning of the contact can cause erratic arc movement, inefficient extinguishment of the arc and burning of the surfaces at which the arc roots.

A theoretical discussion relating to the rotation of arcs to assist in the extinguishment thereof is given in a paper by Fujiwara, K., Ono, S.I., entitled "Rotating Arc Driven by Magnetic Flux in $SF_6$ Gas", 2nd International Symposium on Switching Arc Materials, Part II (Post conference materials), Lodz Poland, Sept. 25–27, 1973, (published Lodz, Poland: Tech. Univ. Lodz 1975), pages 62–67.

BRIEF SUMMARY OF THE INVENTION

An object of the invention is to provide an arc interrupter in which the requirement for precise positioning of a movable contact is avoided.

An arc interrupter, according to the invention, comprises a fixed contact and a fixed electrode which provide, respectively, first and second coaxial arcing surfaces separated by an annular gap, said first arcing surface being closer to the common axis of said arcing surfaces than said second arcing surface, an arc-driving coil coaxial with said arcing surfaces, said coil being electrically connected at one end to said electrode, structure means defining a pivot axis and a movable contact which is mounted on said structure means for angular movement about said pivot axis between a make position in which said movable contact extends from said pivot axis towards said common axis and is in engagement with said fixed contact and in which said movable contact is included in an openable main current path and a break position in which said movable contact is disengaged from said fixed contact and the least distance between said contacts is greater than said gap, said coil being included in series with said arcing surfaces in an arc current path during a later part of movement of said movable contact from said make position to said break position.

The pivot axis is preferably parallel to said common axis. The movable contact is preferably normal to said pivot axis.

The invention includes an electric switch comprising at least one interrupter according to the invention.

BRIEF DESCRIPTION OF THE DRAWINGS

Electric switches will now be described by way of example only to illustrate the invention with reference to the accompanying drawings, in which.

DESCRIPTION OF THE INVENTION

Figure 1:
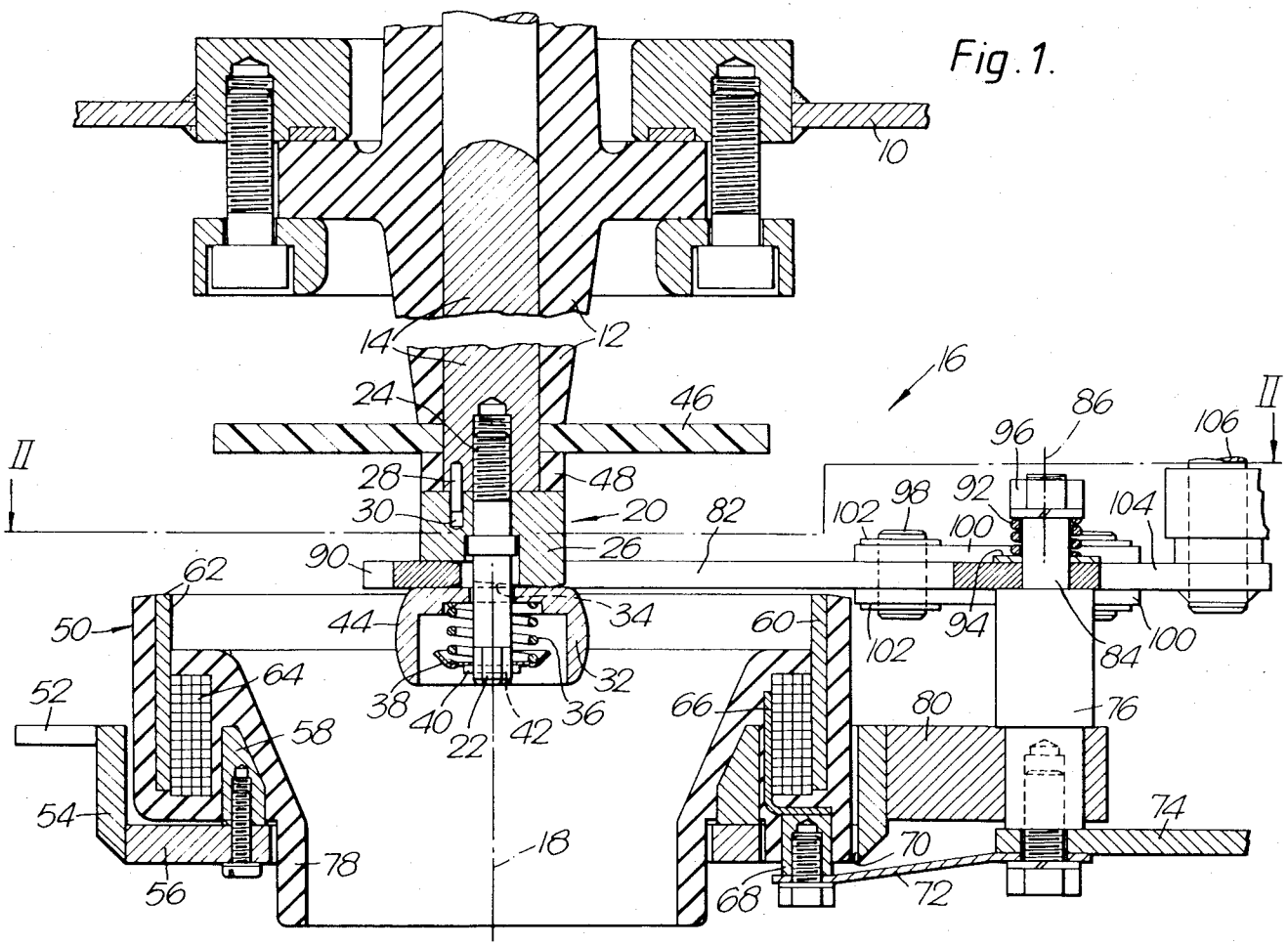
FIG. 1 is a vertical section on the line I—I in FIG. 2 through part of an electric switch including an arc interrupter.

An electric switch (see FIGS. 1 and 2) has a housing 10 of metal for example defining an enclosure which is filled with an insulating medium, for example sulphur hexafluoride ($SF_6$) gas under pressure. A bushing 12 insulates a main copper conductor 14 from, and enables it to pass in sealed relationship through, the housing 10. A second main conductor (not shown) is similarly mounted relative to the housing 10 at a location remote from the conductor 14. The two main conductors carry one phase of the current supplied through the switch.

An arc interrupter 16 forms part of an openable main current path between the two main conductors. The conductor 14 and the interrupter 16 are coaxial with one another on the common axis 18.

The interrupter 16 has a fixed contact 20 which is mounted on the inner end of the conductor 14. The contact 20 has a brass stud 22 which is screwed into a threaded bore 24 in the conductor 14. A first annular copper contact member 26 is mounted on, and is held in engagement with the conductor 14 by, the stud 22. A peg 28, fixed in a bore in the end of the conductor 14, extends into a bore 30 to substantially prevent rotation of the member 26 relative to the conductor 14. A second annular copper contact member 32 is located on the stud 22. A segment has been removed from one side of the member 26 to allow a movable contact 82 (described more fully below) to sit between the members 26 and 32. The lower surface 34 of the member 26 is slightly inclined to a line which is normal to the axis 18.

The contact member 32 is cup-shaped and is retained relative to the stud 22 by a steel compression spring 36, which is located within the contact member 32 and is trapped between the base of the contact member 32 and a spring cup 38. The spring cup 38 is retained on the stud 22 by a pin 40 located in a transverse passage 42 in the free end of the stud 22.

The spring 36 acts on the contact member 32 so that it tends to pivot about the stud 22 in a direction transversely of the axis 18 (as it is permitted to do because of the inclined surface 34 of the contact member 26) whereby contact pressure is exerted on the portion of the movable contact 82 that is located between the contact members 26 and 32.

The contact members 26 and 32 are coaxial with the axis 18. The member 32 is of slightly greater diameter than the member 26 and is provided with a first arcing surface 44 coaxial with the axis 18 so that the movable contact 82, upon opening operation of the interrupter 16, disengages from the member 32 after it has disengaged from the member 26 and an arc is struck preferentially between the arcing surface 44 of the member 32 and the contact 82 instead of between the member 26 and the contact 82.

An annular shield 46 of, for example, polytetrafluoroethylene (PTFE) is located on the conductor 14 between a hollow cylindrical spacer 48 of insulating material, for example, which rests on the first member 26 of the contact 20 and the inner end of the bushing 12. The shield 46 provides protection for the bushing 12 from the effects of any arcing which occurs during operation of the interrupter 16.

A fixed assembly 50 is secured to support members (not shown), fixed to the housing 10, by three support lugs 52 welded to the assembly 50. The assembly 50 is coaxial with the axis 18. The assembly 50 comprises a cylindrical arcing electrode, an arc-driving coil and ferromagnetic material described next below.

The ferromagnetic material is mild steel and consists of a hollow cylinder 54, an annular plate 56 welded at its outer periphery to the lower end of the outer cylinder 54 and an inner hollow cylinder 58 secured on top of the plate 56 within the outer cylinder 54. An arcing electrode 60 in the form of a hollow copper cylinder is positioned within, and extends beyond the upper end of, the cylinder 54. The upper inner and the top surfaces at 62 of the electrode 60 form a second arcing surface coaxial with the axis 18 which is spaced from and positioned substantially opposite to the arcing surface 44 of the contact 20 so that an annular gap exists between the arcing surfaces 44 and 62.

An arc-driving coil 64, constructed of twenty turns of copper tape interleaved with insulating tape, for example, is located within, and is supported against electromagnetic bursting forces by, the electrode 60. The outer end of the coil 64 is electrically connected to the electrode 60. The inner end of the coil 64 is electrically connected to a first L-shaped copper connecting strip 66 which has a terminal block 68 attached to its lower limb. The terminal block 68 extends downwardly through an aperture 70 in the plate 56. A second copper connecting strip 72, having its ends bent in opposite directions out of plane of the strip, is secured to the terminal block 68 by one end. The strip 72 is, at its other end, in electrical contact with one end of a third copper connecting strip 74, the ends of the strips 72 and 74 that are in contact are bolted to one end of a cylindrical copper pivot block 76. The third strip 74 is electrically connected to the other main copper conductor (not shown).

Except for the arcing surface at 62, the arcing electrode 60 is substantially encapsulated in insulating material, indicated by the reference numeral 78, together with the coil 64 and almost all of the cylinder 58. The insulating material 78 extends well below the inner part of the plate 56 to eliminate the possibility that an arc may be struck between the fixed contact 20 and the plate 56.

The ferromagnetic material forms part of the magnetic circuit of the coil 64 when the coil 64 is energised. The positioning of the coil 64 internally of the electrode 60 enables the gap between the arcing surfaces 44 and 62 to be maximised without creating an unduly large interrupter.

The pivot block 76 is screwed into a support member 80 which extends from the cylinder 54. A movable contact 82 is mounted on a stud 84 integral with the upper end of the block 76. The contact 82 is movable in a plane about a pivot axis which is coaxial with the central longitudinal axis 86 of the stud 84 between a make position in which it is in engagement with the fixed contact 20 (shown in full in FIGS. 1 and 2) and a break position in which it is disengaged from the contact 20 (shown in ghost outline at 88 in FIG. 2). The axis 86 is parallel to the axis 18 and the contact 82 is normal to the axis 86. Thus, the length of the interrupter 16, in a direction parallel to the axis 18, is kept to a minimum.

Figure 2:
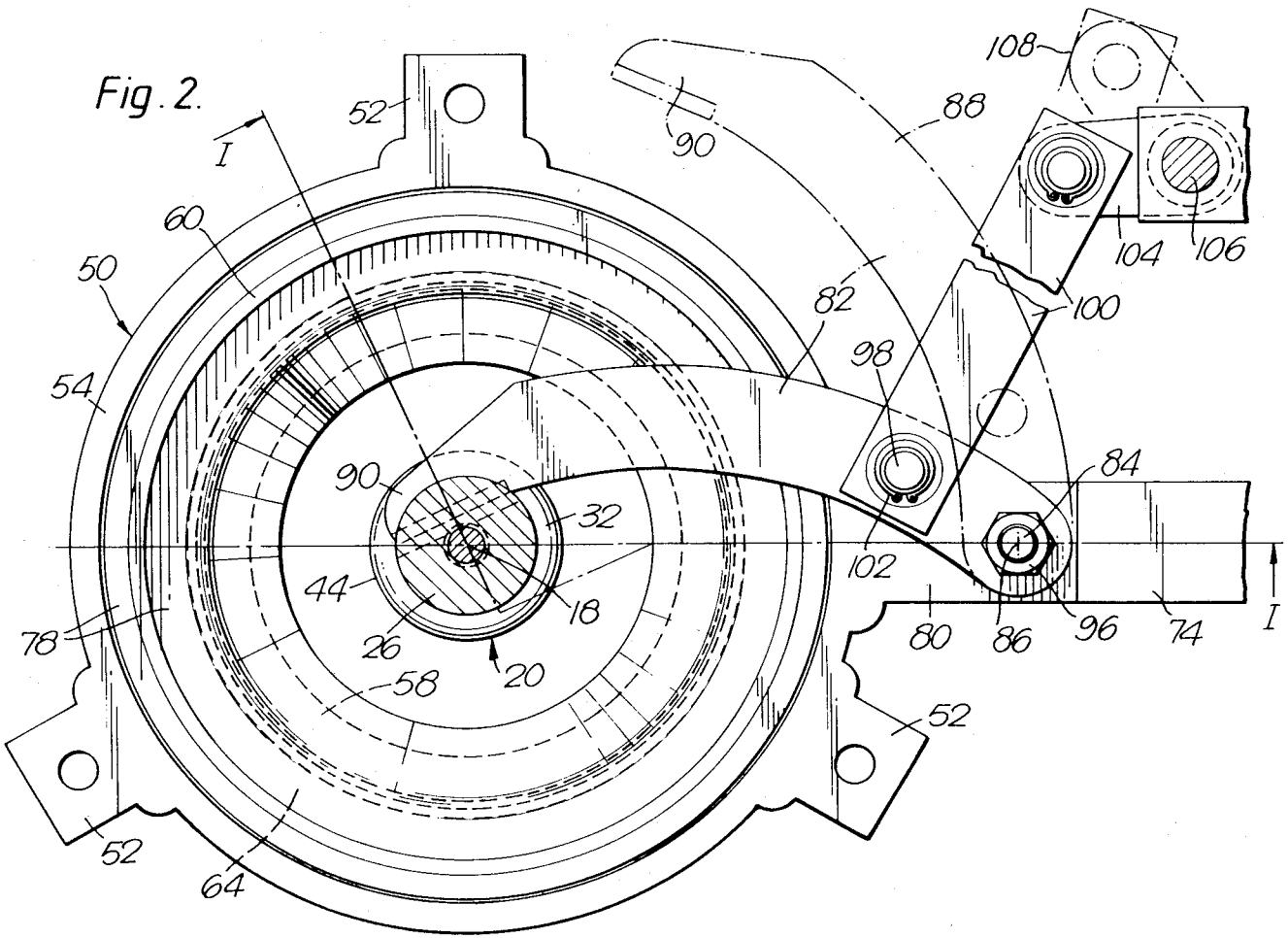
FIG. 2 is a horizontal section on the line II—II in FIG. 1.

The contact 82 is a copper bar which has a substantially arcuate shape when seen along the axis 86 (see FIG. 2). The end portion 90 of the contact 82 which is in engagement with the fixed contact 20 in the make position is the portion of the contact 82 closest to the electrode 60 in the break position. The least distance between the contacts 20 and 82 is greater than the gap between the surfaces 44 and 62. The end portion 90 of the contact 82 has a slightly tapered leading edge to assist the contact 82 to engage the fixed contact 20.

The contact 82 is resiliently retained on the stud 84 by a compression spring 92 trapped beyween a PTFE-faced thrust-bearing washer 94 and a washer held by a nut 96 engaging the threaded free end of the stud 84.

The contact 82 has a hole in which a link pin 98 is located, the pin 98 also passing through a hole in the end of each of a pair of links 100, of insulating material, positioned on either side of the contact 82. The pin 98 is retained in position by spring clips 102. The other ends of the links 100 are similarly pivotally secured to a mild steel lever 104 which is fixed to a rotatable connecting rod 106 for rotation therewith. The rod 106 is rotatable by a further lever (not shown) fixed thereto. The further lever is angularly movable by an operating link (not shown).

OPERATION

The interrupter 16 is shown in the closed position. The main current path is through the main conductor 14, the fixed contact 20 (the contact members 26 and 32 of which are forced slightly apart by the movable contact 82), the movable contact 82, the pivot block 76, the third strip 74 and the other main conductor (not shown).

Actuation of the operating mechanism turns the rod 106 and the lever 104. The lever 104 pulls the link 100 to the position shown in dotted outline at 108, which causes the movable contact 82 to rotate in a plane about the axis 86 to the position shown in ghost outline at 88.

During movement of the movable contact 82, it first disengages from the contact member 26 of the contact 20 and then from the member 32. Upon disengagement of the contact 82 from the member 32, an arc is struck between the contact 82 and the member 32. Electromagnetic forces act on the arc and cause the arc root on the contact 82 to move to the tip of the contact 82.

As the contact 82 moves further away from the contact 20, the lengthening arc tends to bow downwardly under the influence of electromagnetic forces. When the end of the contact 82 passes over the arcing electrode 60, the arc transfers to the electrode 60. The arc transfer is assisted by the bowing of the arc. During a transitionary state, the arc extends both between arcing surface 44 and the electrode 60 and between the electrode 60 and the tip of the contact 82. However, the latter portion of the arc soon extinguishes. As the end portion 90 of the contact 82 is the portion of the contact 82 closest to the electrode 60 in the break position, spurious re-establishment of an arc between the electrode 60 and the contact 82 at other positions along the length of the contact 82 is unlikely to occur.

Thus, the main current path is switched to an arc current path which is through the main conductor 14, the fixed contact 20, the arc extending between the surfaces 44 and 62, the arcing electrode 60, the arc-driving coil 64, the first strip 66, the terminal block 68, the second strip 72, the third strip 74 and the other main conductor (not shown). The arc-driving coil 64 is energised and produces a magnetic flux with which the arc interacts and is driven around the arcing surfaces 44 and 62 like a spoke in a rotating wheel. The magnetic field of the coil 64 is intensified by the relatively large amount of ferromagnetic material which forms part of the magentic circuit of the coil 64.

The movement of the arc through the $SF_6$ gas aids in dissipating energy from the arc and ionised gas from the vicinity of the arc so that conditions are optimised for the arc to extinguish at a current zero. Such conditions are further optimised by the arcing electrode 60, which, because it is magnetically coupled to the coil 64 and has a suitable conductivity, causes the magnetic flux and the arc current to be put out of phase so that the arc is still subject to the high driving forces as the current approaches zero.

At an appropriate current zero, the arc is extinguished.

The interrupter 16 is closed by reverse operation of the rod 106 causing the lever 104, the links 100 and the movable contact 82 to return to the positions shown in full.

The switch described with reference to FIGS. 1 and 2 has a normal rating of 15.5 kilovolts (kV), 0.28 kiloamperes (kA) and a fault-condition rating of 6 kA. The particular switch described is an automatic recloser type of switch. In recloser switches, an interrupter 16 is provided for each phase of current supplied, the lever (not shown) attached to the rod 106 of each interrupter 16, when there is more than one provided, is connected to a common operating link (not shown). However, other applications for switches having interrupters constructed in accordance with the invention are envisaged, for example ring-main switches. The axis of the interrupter 16 can be other than vertical. The switch can have a housing made from insulating material, for example cast epoxy resin.

For other applications, for example for ring-main switches (which has a normal rating of 15.5 kV, 0.63 kA and fault rating of 12 kA), the rating of the switch can be varied. A higher or lower rating for the switch can be achieved in a number of ways either alone or in combination depending on the variation required. For example, the interrupter contact pressure can be altered; the size of the components of the interrupter can be altered; and the movable contact of the interrupter can be made up of at least two contact members thereby increasing the number of contact interfaces to increase the rating.

Alternatively, the rating of switches can be increased by using two or more interrupters which are operable simultaneously with one another and which are connected in series between the main conductors of a current phase. In one such application (see FIG. 3), the coil 64 of a first interrupter 16 is connected to the fixed contact 20 of a second interrupter 16. The interrupters 16 have a construction substantially as described above with reference to FIGS. 1 and 2.

Figure 4:
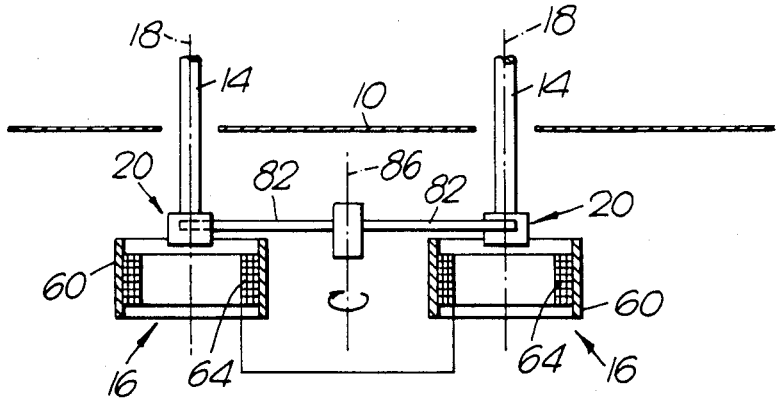

In another such application (see FIG. 4), the coil 64 of a first interrupter 16 is connected to the coil 64 of a second interrupter 16 and the fixed contact 20 of each interrupter 16 is connected to a respective one of the two main conductors 14. These interrupters 16 also have a construction substantially as described above with reference to FIGS. 1 and 2. In this arrangement, the movable contacts 82 of the interrupters can be constituted by a single S-shaped member which is movable about a single pivot axis 86 disposed midway between the fixed contacts 20 of the interrupters 16.

In a further alternative, the rating of switches can be increased by using an interrupter which has two fixed contacts coaxial with, and facing, one another and each providing a respective first arcing surface, two fixed electrodes spaced apart from one another and each providing a respective second arcing surface, said second arcing surfaces being remote from one another; two of said coils each electrically connected at their second end to one another; and two of said movable contacts each mounted for said angular movement relative to a respective one of said second arcing surfaces, said movable contacts being electrically connected to, and movable simultaneously with, one another.

Figure 5:
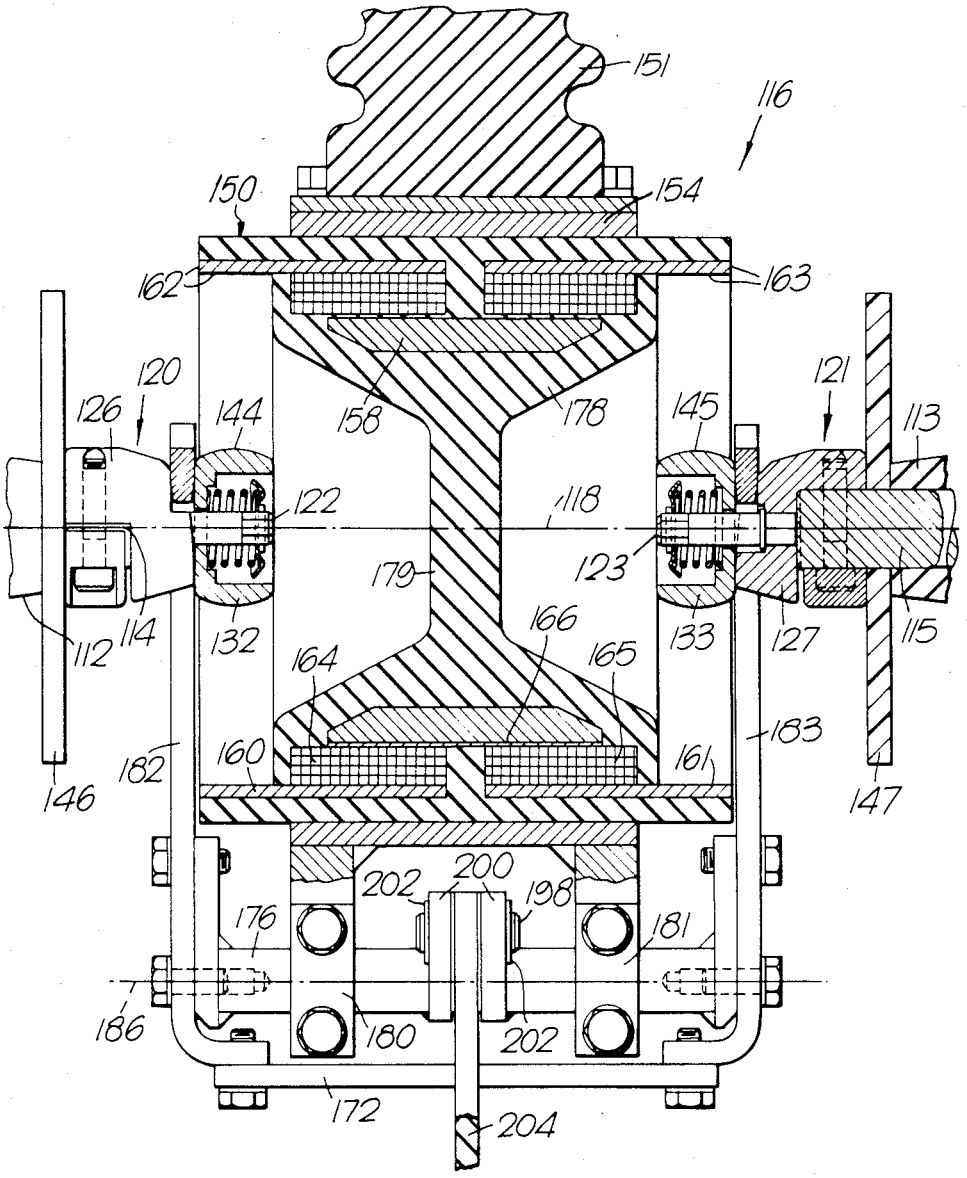
FIG. 5 is a section similar to FIG. 1 of another embodiment of an electric switch.

One particular embodiment of the type of switch described generally in the preceding paragraph will now be described with reference to FIG. 5.

The switch has a metal housing (not shown) defining an enclosure filled with insulating medium, e.g. $SF_6$ gas. Bushings 112, 113 insulate the two main copper conductors 114, 115, respectively, from, and enable them to pass in sealed relationship through, the housing. The conductors 114, 115 carry one phase of the current supplied through the switch.

An arc interrupter 116 forms an openable main current path between the two main conductors 114, 115. The conductors 114, 115 and the interrupter 116 are coaxial with one another on the common axis 118.

The interrupter 116 has fixed contacts 120, 121 which face each other. The contacts 120, 121 have respective studs 122, 123 screwed into respective first annular copper contacts 126, 127 which are each in two parts clamped together on the ends of the respective main conductors 114, 115. The end surfaces of the contacts 120, 121 are each slightly inclined to a line normal to the axis 118. Respective second annular copper contact members 132, 133, having respective first arcing surfaces 144, 145 coaxial with the axis 118, are located on the studs 122, 123. The members 132, 133 are substantially the same as the member 32 described with reference to FIGS. 1 and 2.

Protective shields 146, 147, similar to the shield 46, are provided, respectively, on the conductors 114, 115.

A fixed assembly 150 is secured to a support member 151 of insulating material which is secured to the housing. The assembly 150 is coaxial with the axis 118. The assembly 150 comprises two cylindrical arcing electrodes, two arc-driving coils and ferromagnetic material described next below.

The ferromagnetic material is mild steel and consists of an outer hollow cylinder 154 and an inner hollow cylinder 158 both of which are coaxial with the axis 118. Two arcing electrodes 160, 161 in the form of hollow copper cylinders are positioned within and extend beyond respective ends of the cylinder 154. The inner and top surfaces at 162, 163 of the protruding ends of the electrodes 160, 161, respectively, form arcing surfaces coaxial with the axis 118 which are spaced from and positioned substantially opposite to the respective arcing surfaces 144, 145 of the fixed contacts 132, 133 so that respective annular gaps exist between the arcing surfaces 144, 162 and 145, 163.

Arc-driving coils 164, 165 are mounted within, and are connected at their outer ends to, the electrodes 160, 161, respectively, similarly to the coil 64 described with reference to FIGS. 1 and 2. The inner ends of the coils 164, 165 are connected to each other by a copper connecting strip 166.

Except for the arcing surfaces at 162, 163, the arcing electrodes are substantially encapsulated in insulating material, indicated by the reference numeral 178, together with the coils 164, 165 and the cylinder 158. The insulating material extends across the centre of the interrupter 116 as indicated at 179 to provide a physical insulated barrier to prevent any arcing occurring across that space.

The fixed contacts 120, 121 are electrically connected to one another, in the closed condition of the interrupter, by respective movable contacts 182, 183 which are electrically connected to one another and which are simultaneously movable with one another. In this embodiment, the contacts 182, 183 are mounted on opposite ends of a steel pivot shaft 176 for movement in respective planes about a common pivot axis coaxial with the longitudinal axis 186 of the shaft 176 between respective make positions in which they are in engagement with the respective fixed contacts 120, 121 (shown in FIG. 3) and respective break positions in which they are disengaged from the respective contacts 120, 121. The contacts 182, 183 are electrically connected to one another by way of a copper connecting strip 172 bolted to the contacts 182, 183. The axis 186 is parallel to the axis 118 and the contacts 182, 183 are normal to the axis 186. Thus, the length of the interrupter 116, in a direction parallel to the axis 118, is kept to a minimum.

The contacts 182, 183 are of a shape similar to the shape of the contact 82 described with reference to FIGS. 1 and 2 and, like the contacts 20 and 82, the least distance between the contacts 120 and 182 and 121 and 183, respectively, is greater than the respective gap between the surfaces 144 and 162 and 145 and 163.

The shaft 176 is supported in bearings formed by two support members 180, 181 which extend from the cylinder 154.

The shaft 176 has two central levers 200 secured to it, a link 204 of insulating material being pivotally secured between the levers 200 by a link pin 198 retained relatively thereto by spring clips 202. Movement of the link 204 by means not shown causes rotation of the shaft 176.

OPERATION

The interrupter 116 is shown in the closed position. The main current path is through the main conductor 114, the fixed contact 120, the movable contact 182, the strip 172, the movable contact 183, the fixed contact 121 and the main conductor 115.

Actuation of the operating mechanism pulls the link 204 and rotates the shaft 176 which causes the movable contacts 182, 183 to simultaneously rotate in respective planes about the axis 186.

Arcs are established, and subsequently extinguished, between the surfaces 144 and 162 and between the surfaces 145 and 163, respectively, in a similar manner to the establishment, and subsequent extinguishment, of an arc between the surfaces 44 and 62 described with reference to FIGS. 1 and 2.

The interrupter 116 is closed by reverse operation of the link 204.

The interrupter 116 has a normal rating of 36 kV.

Where an interrupter has a relatively high rating, arc-resistant material, e.g. Elkonite (trade name), can be used for those portions of the contacts on which the arc roots.

Figure 3:
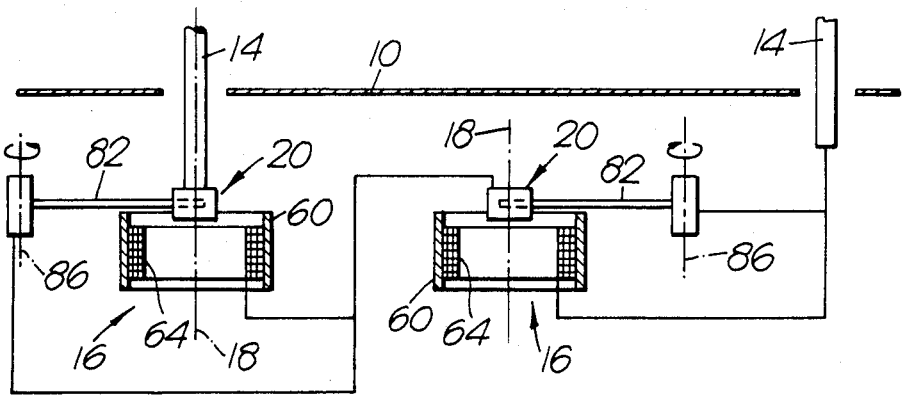
FIGS 3 and 4 are schematic drawings of switches having at least two interrupters.

As described above, the rating of a switch can be increased by using two or more interrupters of the type described with reference to FIGS. 1 and 2 or by using an interrupter (or possibly more than one such interrupter) of the type described with reference to FIG. 3. However, in a switch having a particular rating, a single interrupter of the type described with reference to FIGS. 1 and 2 can be replaced by two or more such interrupters or by an interrupter of the type described with reference to FIG. 3 with no change occurring in the rating. In those circumstances, the two or more interrupters or the interrupter of the type described with reference to FIG. 3 will be smaller than the single interrupter that is replaced. Thus, the phase-to-phase spacing in the switch can be decreased.

In a further modification, the arc-driving coil or coils could be located radially outwardly of the arcing electrode or electrodes.

Although the common axis of the components and the pivot axis of the movable contact are parallel in the described embodiments, those axes may be disposed other than parallel in some constructions. However, the pivot axis will not be disposed at right-angles to the common axis.

What I claim is:

1. An arc interrupter comprising a fixed contact and a fixed electrode which provide, respectively, first and second coaxial arcing surfaces separated by an annular gap, said first arcing surface being closer to the common axis of said arcing surfaces than said second arcing surface, an arc-driving coil coaxial with said arcing surfaces, said coil being electrically connected at one end to said electrode, structure means defining a pivot axis and a movable contact which is mounted on said structure means for angular movement about said pivot axis between a make position in which said movable contact extends from said pivot axis towards said common axis and is in engagement with said fixed contact and in which said movable contact is included in an openable main current path and a break position in which said movable contact is disengaged from said fixed contact and the least distance between said contacts is greater than said gap, said coil being included in series with said arcing surfaces in an arc current path during a later part of movement of said movable contact from said make position to said break position.

2. An arc interrupter comprising a fixed contact and a fixed electrode which provide, respectively, first and second coaxial arcing surfaces separated by an annular gap, said first arcing surface being closer to the common axis of said arcing surfaces than said second arcing surface , an arc-driving coil coaxial with said arcing surfaces, said coil being electrically connected at one end to said electrode, structure means defining a pivot axis and a movable contact which is mounted on said structure means for angular movement about said pivot axis between a make position in which said movable contact extends from said pivot axis towards said common axis and is in engagement with said fixed contact and in which said movable contact is included in an openable main current path and a break position in which said movable contact is disengaged from said fixed contact and the least distance between said contacts is greater than said gap, said coil being included in series with said arcing surfaces in an arc current path during a later part of movement of said movable contact from said make position to said break position and said pivot axis being parallel to said common axis.

3. An arc interrupter comprising a fixed contact and a fixed electrode which provide, respectively, first and second coaxial arcing surfaces separated by an annular gap, said first arcing surface being closer to the common axis of said arcing surfaces than said second arcing surface, an arc-driving coil coaxial with said arcing surfaces, said coil being electrically connected at one end to said electrode, structure means defining a pivot axis and a movable contact which is mounted on said structure meansfor angular movement about said pivot axis between a make posktion in which said movable contact extends from said pivot axis towards said common axis and is in engagement with said fixed contact and in which said movable contact is included in an openable main current path and a break position in which said movable contact is disengaged from said fixed contact and the least distance between said contacts is greater than said gap, said coil being included in series with said arcingsurfacesin an arc current path during a later part of movement of said movable contact from said make position to said break position, said pivot axis being parallel to said common axis and said movable contact being normal to said pivot axis.

4. An interrupter according to claim 1, in which said interrupter comprises two of said fixed contacts coaxial with, and facing, one another and each providing a respective said first arcing surface, two of said fixed electrodes spaced apart from one another and each providing a respective said second arcing surface, said second arcing surfaces being remote from one another, two of said coils each electrically connected at their second end to one another, said structure means defining two of said pivot axes and two of said movable contacts each mounted for said angular movement relative to a respective one of said second arcing surfaces, said movable contacts being electrically connected to, and movable simultaneously with, one another.

5. An interrupter according to claim 4, in which said pivot axes of said movable contacts are coaxial with one another.

6. An interrupter according to claim 1, in which said electrode comprises a hollow cylinder extending lengthwise away from said fixed contact which is positioned at one open end of said cylinder at which said second arcing surface is provided.

7. An interrupter according to claim 6, in which said coil is within, and is supported against magnetic forces by, said cylinder.

8. An interrupter according to claim 1, in which said interrupter comprises ferromagnetic material which forms part of a magnetic circuit produced by said coil when said coil is part of said arc current path.

9. An electric switch comprising a housing containing insulating medium and conductor means which form an openable main current path within the housing and which include at least one arc interrupter which comprises a fixed contact and a fixed electrode which provide, respectively, first and second coaxial arcing surfaces separated by an annular gap, said first arcing surface being closer to the common axis of said arcing surfaces than said second arcing surface, an arc-driving coil coaxial with said arcing surfaces, said coil being electrically connected at one end to said electrode, structure means defining a pivot axis and a movable contact which is mounted on said structure means for angular movement about said pivot axis between a make position in which said movable contact extends from said pivot axis towards said common axis and is in engagement with said fixed contact and in which said movable contact is included in an openable main current path and a break position in which said movable contact is disengaged from said fixed contact and the least distance betweeh said contacts is greater than said gap, said coil being included in series with said arcing surfaces in an arc current path during a later part of movement of said movable contact from said make position to said break position.

10. A switch according to claim 9, in which said pivbt axis is parallel to said common axis.

11. A switch according to claim 9, in which said movable contact is normal to said pivot axis.

12. A switch according to claim 9, in which said conductor means include two of said interrupters which are operable simultaneously with one another and which are electrically connected to one another in series.

13. A switch according to claim 9, in which said interrupter comprises two of said fixed contacts coaxial with, and facing, one another and each providing a respective said first arcing surface, two of said fixed eleqtrodes spaced apart from one another and each providing a respective said second arcing surface, said second arcing surfaces being remote from one another, two of said coils each electrically connected at their second end to one another, said structure means defining two of said pivot axes and two of said movable contacts each mounted for said angular movement relative to a respective one of said second arcing surfaces, said movable contacts being electrically connected to, and movable simultaneously with, one another.

14. A switch according to claim 13, in which said pivot axes of said movable contacts are coaxial with one another.

* * * * *